US011577418B2

(12) United States Patent
Chen

(10) Patent No.: US 11,577,418 B2
(45) Date of Patent: Feb. 14, 2023

(54) APPARATUS AND METHOD FOR MAKING AND CUTTING PAPER TUBE

(71) Applicant: CHAN LI MACHINERY CO., LTD., Taichung (TW)

(72) Inventor: Ting Chao Chen, Taichung (TW)

(73) Assignee: Chan Li Machinery Co., Ltd., Tainan (TW)

( * ) Notice: Subject to any disclaimer, the term of this patent is extended or adjusted under 35 U.S.C. 154(b) by 0 days.

(21) Appl. No.: 17/205,216

(22) Filed: Mar. 18, 2021

(65) Prior Publication Data

US 2021/0316469 A1 Oct. 14, 2021

(30) Foreign Application Priority Data

Apr. 8, 2020 (TW) ..... 109111786

(51) Int. Cl.
*B26D 1/10* (2006.01)
*B31C 3/04* (2006.01)

(52) U.S. Cl.
CPC ..... *B26D 1/105* (2013.01); *B31C 3/04* (2013.01)

(58) Field of Classification Search
CPC .. B31C 11/00; B31C 3/00; B31C 3/04; B31C 1/00; A47G 21/18; A47G 21/186; A47G 21/189
See application file for complete search history.

(56) References Cited

U.S. PATENT DOCUMENTS 4,220,077 A * 9/1980 Miller ..... B26D 5/32 493/11
4,378,966 A * 4/1983 Schumacher ..... B31C 3/00 83/76

(Continued)

FOREIGN PATENT DOCUMENTS

JP H10180906 A 7/1998
JP 2003340944 A 12/2003

OTHER PUBLICATIONS

International Office Action Issued by Foreign Patent Office for Application No. 202010268841.6/2022030202182610 dated Mar. 7, 2022.

(Continued)

*Primary Examiner* — Chelsea E Stinson
(74) *Attorney, Agent, or Firm* — Rosenberg, Klein & Lee

(57) ABSTRACT

A paper tube making and cutting machine includes a fixed rod, a paper tape winding mechanism, an angle measurement unit, a length measurement unit, a cutter, and a drive mechanism. The paper tape winding mechanism wraps or winds at least one paper tape around the fixed rod to form a paper tube. The angle measurement unit measures an angle of the paper tape winding mechanism or the paper tape relative to the fixed rod. The length measurement unit measures a conveyed length of the paper tape. The drive mechanism determines and sets a moving speed of the cutter along the fixed rod according to the angle and the conveyed length, such that the moving speed of the cutter is corresponding to or close to a producing speed or generation rate of the paper tube formed on the fixed rod, in order to prevent the paper tube from pushing a side surface of the cutter or to prevent the cutter from pulling and stretching the paper tube to thereby improve durability of the cutter and the quality of a cut paper tube.

3 Claims, 7 Drawing Sheets

(56) References Cited

U.S. PATENT DOCUMENTS

| | | | | |
|---|---|---|---|---|
| 4,473,368 | A | 9/1984 | Meyer | |
| 6,270,004 | B1 * | 8/2001 | Drummond | B29C 53/60 229/4.5 |
| 2008/0156927 | A1 * | 7/2008 | Rummage | B31C 3/00 242/610 |

OTHER PUBLICATIONS

International Office Action Issued by Foreign Patent Office for Application No. 2021065269 dated Mar. 1, 2022.

International Office Action Issued by Foreign Patent Office for Application No. 202010268841.6/2022051702625780 dated May 20, 2022.

* cited by examiner

APPARATUS AND METHOD FOR MAKING AND CUTTING PAPER TUBE

BACKGROUND OF THE INVENTION

1. Field of the Invention

The present invention relates to a paper tube making and cutting machine, in which a moving speed of a cutter is made close to a producing speed or making rate of a paper tube formed on a fixed rod in order to improve durability of the cutter and the quality of a cut paper tube.

2. The Related Arts

A paper tube making and cutting machine is generally applied to wrap or wind at least one paper tape to form a paper tube and to subject the paper tube to cutting by means of a cutter in order to manufacture paper tubes of a predetermined length. The paper tube has various uses. For example, a paper tube may serve as a paper drinking straw. In addition, toilet tissue may be wound around a paper tube to provide a toilet paper roll.

Generally, during a process of cutting a paper tube by using a cutter, a paper tube making and cutting machine is still in operation for continuous generation an additional portion of the paper tube, and consequently, the subsequently generated portion of the paper tube would push one side or surface of the cutter. This would affect the quality of cutting the paper tube and also lead to potential damage to the cutter.

To provide a solution to the above drawbacks of the prior art, the present invention proposes a novel paper tube making and cutting machine, which effectively enhances the cutting quality of a paper tube and also helps extend the service life of the cutter.

To provide a solution to the above drawbacks of the prior art, the present invention proposes a novel paper tube making and cutting machine, which effectively enhances the cutting quality of a paper tube and also helps extend the service life of the cutter.

SUMMARY OF THE INVENTION

An objective of the present invention is to provide a paper tube making and cutting machine, in which when a cutter is operated to cut off a paper tube, the cutter is moving with a moving direction and a moving speed that are identical to a producing direction and a producing speed of the paper tube, so as to enhance the cutting quality of the paper tube and also to extend the service life of the cutter.

An objective of the present invention is to provide a paper tube making and cutting machine, which mainly includes a paper tape winding mechanism to wrap or wind at least one paper tape around a fixed rod to form and make a paper tube. Further, an angle measurement unit is included to measure an angle of the paper tape winding mechanism or the paper tape relative to the fixed rod, and a length measurement unit is included to measure a conveyed length of the paper tape. A drive mechanism is operable to determine and set a speed at which the cutter moves along the fixed rod according to the angle and the conveyed length, such that the moving speed of the cutter is corresponding to or close to a speed or rate at which the paper tube is formed and producing on the fixed rod in order to prevent the paper tube from pushing a side or surface of the cutter or to prevent the cutter from pulling or stretching the paper tube to thereby enhance the durability of the cutter and the quality of a cut paper tube.

An objective of the present invention is to provide a paper tube cutting method, in which an angle of a paper tape winding mechanism or a paper tape relative to a fixed rod is first measured and a conveyed length of the paper tape is measured. And, then, a producing speed or generation rate of a paper tube is calculated according to the angle, the conveyed length, and a width of the paper tape and/or a radius of the fixed rod, and a moving speed of the cutter is adjusted according to the producing speed or generation rate of the paper tube in order to enhance durability of the cutter and the quality of a cut paper tube.

To achieve the above objectives, the present invention provides a paper tube making and cutting apparatus, which comprises: a fixed rod; a paper tape winding mechanism, which is arranged adjacent to the fixed rod, wherein the fixed rod and the paper tape winding mechanism receive a paper tape and the paper tape winding mechanism winds the paper tape around the fixed rod to form and generate a paper tube; an angle measurement unit, which measures an angle of the paper tape winding mechanism or the paper tape relative to the fixed rod; a length measurement unit, which is arranged an upstream of the fixed rod and the paper tape winding mechanism and measures a conveyed length of the paper tape; a cutter, which is arranged adjacent to the fixed rod to cut off the paper tube formed on the fixed rod; and a drive mechanism, which is coupled to the cutter and is operable to adjust a speed at which the cutter is moved along the fixed rod according to the angle and the conveyed length.

The present invention also provides a method for making and cutting paper tube, which comprises: measuring a conveyed length of at least one paper tape; conveying the paper tape to a fixed rod and a paper tape winding mechanism; measuring a feed-in angle of the paper tape relative to the fixed rod; wrapping the paper tape around the fixed rod to form a paper tube; and adjusting a speed at which a cutter is movable along the fixed rod according to the conveyed length and the feed-in angle.

In the above-described paper tube making and cutting machine, the paper tape winding mechanism comprises a supporting base, a driving roller, at least one pulley, and a belt, the driving roller and the pulley being mounted on the supporting base, the belt being wound around the driving roller, the pulley, and the fixed rod, wherein the paper tape is located between the belt and the fixed rod, such that when the driving roller rotates and drives the belt to wind the paper tape around the fixed rod to form the paper tube.

The above-described paper tube making and cutting machine further comprises at least one slide rail, which is coupled, by means of at least one sliding block, to the cutter, wherein the drive mechanism drives the cutter and the sliding block to move along the slide rail.

The above-described paper tube making and cutting machine further comprises at least one transportation roller, which is arranged upstream of the fixed rod and the paper tape winding mechanism to convey the paper tape to the fixed rod and the paper tape winding mechanism, the length measurement unit being connected to the transportation roller and being operable to count turns of rotation of the transportation roller in order to determine the conveyed length of the paper tape.

The above-described paper tube making and cutting machine further comprises a calculation unit that is in electrical connection with the angle measurement unit, the length measurement unit, and the drive mechanism and is operable to calculate a producing speed of the paper tube according to the angle and the conveyed length and is operable to control the speed at which the cutter is driven by the drive mechanism to move according to the producing speed of the paper tube.

In the above-described paper tube making and cutting machine, the calculation unit receives a radius of the fixed rod and a width of the paper tape and is operable to calculate the producing speed of the paper tube according to the angle, the conveyed length, the radius of the fixed rod, and the width of the paper tape.

The above-described paper tube further comprises: measuring an angle between the paper tape winding mechanism and the fixed rod to calculate the feed-in angle of the paper tape relative to the fixed rod.

The above-described paper tube further comprises: obtaining a radius of the fixed rod and a width of the paper tape; and adjusting the speed at which the cutter is movable along the fixed rod according to the conveyed length, the feed-in angle, the radius of the fixed rod, and the width of the paper tape.

The above-described paper tube further comprises: obtaining a width of an overlapping zone of adjacent portions of the paper tape of the paper tube; and adjusting the speed at which the cutter is movable along the fixed rod according to the conveyed length, the feed-in angle, the radius of the fixed rod, and the width of the paper tape, and the overlapping zone.

DETAILED DESCRIPTION OF THE PREFERRED EMBODIMENTS

Figure 1:
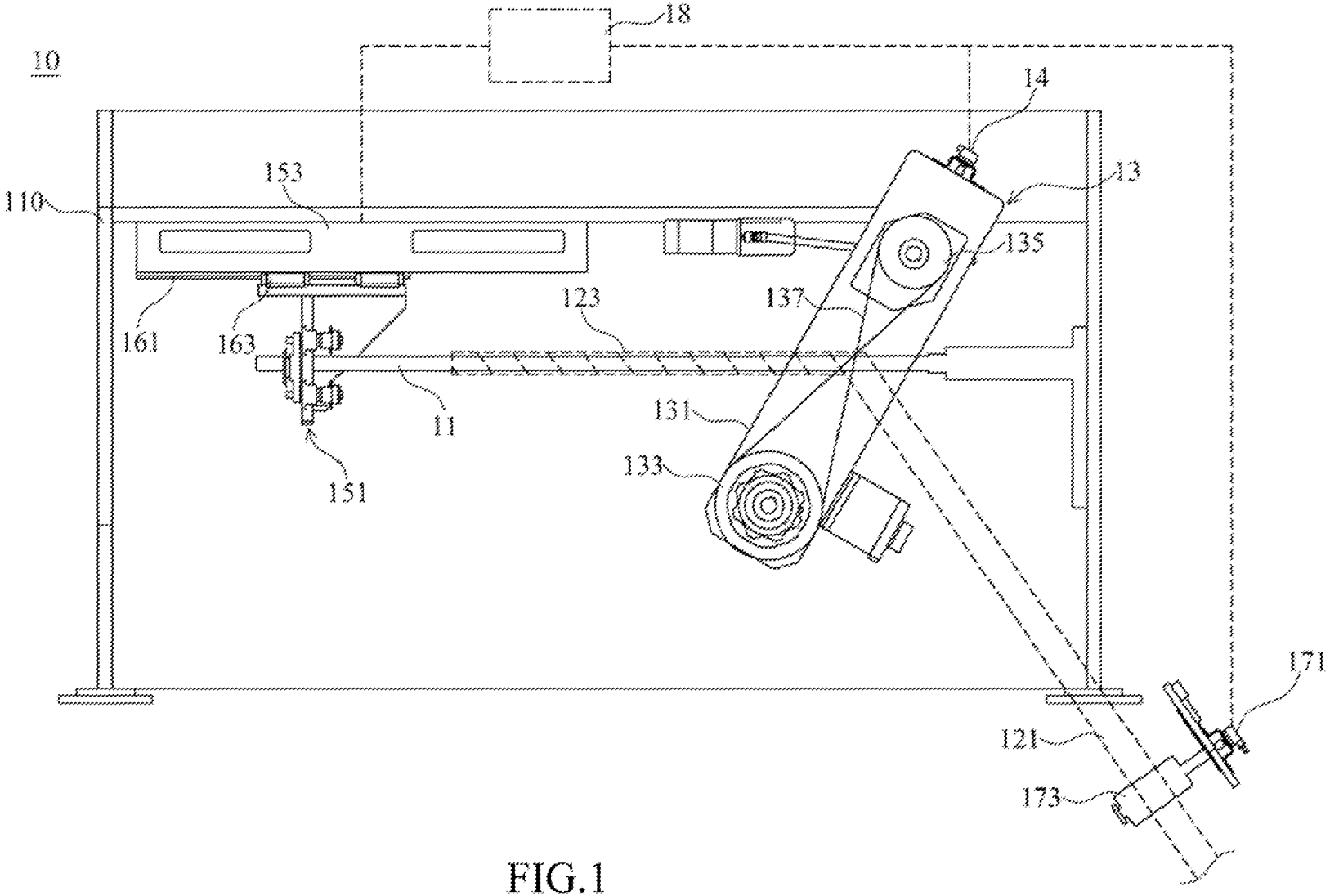
FIG. 1 is a schematic view showing a structure of a paper tube making and cutting machine according to an embodiment of the present invention.
Figure 2:
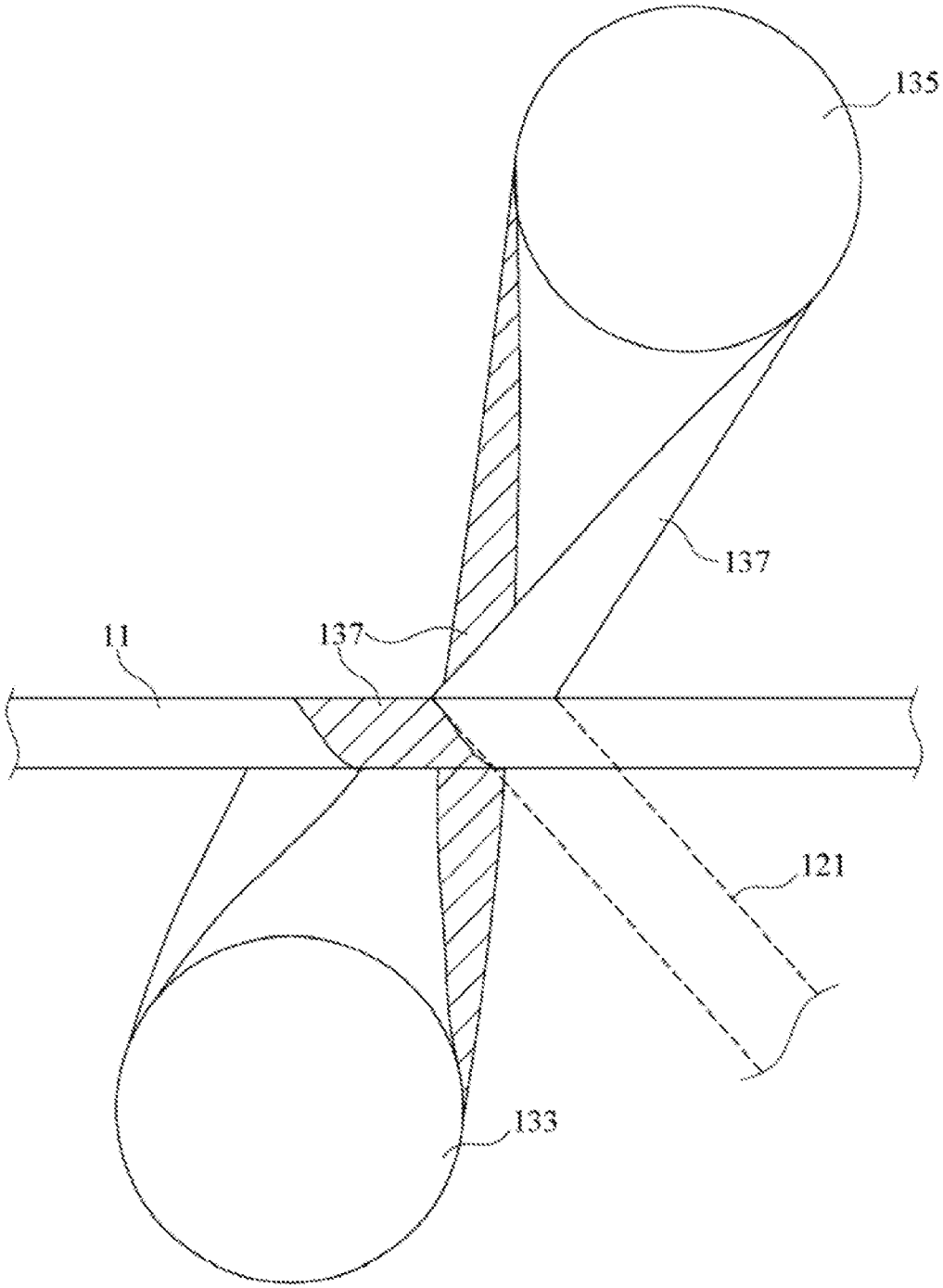
FIG. 2 is a schematic view, in an enlarged form, showing a fixed rod and a paper tape winding mechanism of the paper tube making and cutting machine according to an embodiment of the present invention.

Referring to FIGS. 1 and 2, which are, respectively, a schematic view showing a structure of a paper tube making and cutting machine according to an embodiment of the present invention and a schematic view showing, in an enlarged form, a fixed rod and a paper tape winding mechanism. As shown in the drawings, a paper tube making and cutting machine 10 generally comprises a fixed rod 11, a paper tape winding mechanism 13, an angle measurement unit 14, a length measurement unit 171, a cutter 151, and a drive mechanism 153. The paper tape winding mechanism 13 and the fixed rod are arranged to receive one or multiple paper tapes 121, and the paper tape winding mechanism 13 is operable to wrap or wind the paper tape 121 around the fixed rod 11 to form or make a paper tube 123.

The fixed rod 11 is of a cylindrical form or an elongate bar. The paper tape winding mechanism 13 is arranged adjacent to the fixed rod 11. For example, the fixed rod 11 is arranged as being fixed to a machine frame 110, such that the fixed rod 11 is not rotatable or movable relative to the machine frame 110.

In an embodiment of the present invention, the paper tape winding mechanism 13 comprises a supporting plate 131, a driving roller 133, at least one pulley 135, and a rolling belt 137. The supporting plate 131 can be in the form of an arm plate, and the driving roller 133 and the pulley 135 are mounted on the supporting plate 131 and are rotatable relative to the supporting plate 131. The belt 137 is looped or wound around the driving roller 133 and the pulley 135, such that the driving roller 133, when driven by a motor to rotate, would drive the pulley 135 to rotate by means of the belt 137.

The belt 137 of the paper tape winding mechanism 13 is wound around the fixed rod 11 in the way shown in FIG. 2. For example, the driving roller 133 and the pulley 135 of the paper tape winding mechanism 13 are respectively located below and above the fixed rod 11, and a portion of the belt 137 that is located between the driving roller 133 and the pulley 135 is wound around the fixed rod 11. When the driving roller 133 rotates, the belt 137 is caused to move relative to the fixed rod 11.

In a practical application, at least one paper tape 121 is positioned such that a portion thereof is located in a gap between the fixed rod 11 and the belt 137, such that when the driving roller 133 rotates and thus drives the belt 137 to move relative to the fixed rod 11, the belt 137 is caused to wrap or wind the portion of the paper tape 121 located between the fixed rod 11 and the belt 137 around the fixed rod 11 to form a paper tube 123. The paper tube 123, as being generated in this way, continuously extends or elongates along the fixed rod 11 in a direction toward the cutter 151, until the driving roller 133 stops rotation. In the example shown in the drawings, the present invention is embodied by wrapping or winding one single paper tape 121 around the fixed rod 11 to form the paper tube 123; however, in other embodiments, multiple paper tapes 121 may be wound together around the fixed rod 11 to form the paper tube 123.

In an embodiment of the present invention, the supporting plate 131 is mounted to the machine frame 110 in a manner of being swinging or rotating relative to the machine frame 110. When the supporting plate 131 swing relative to the fixed rod 11, an angle at which the belt 137 is wound around the fixed rod 11 is changed so as to vary or adjust a feed-in angle of the paper tape 121 fed onto the fixed rod 11. The above-described specifics or details of the structure of the paper tape winding mechanism 13 are provided to illustrate one embodiment of the present invention and are not intended to impose undue constraint to the scope of protection that the present invention seeks for.

Figure 3:
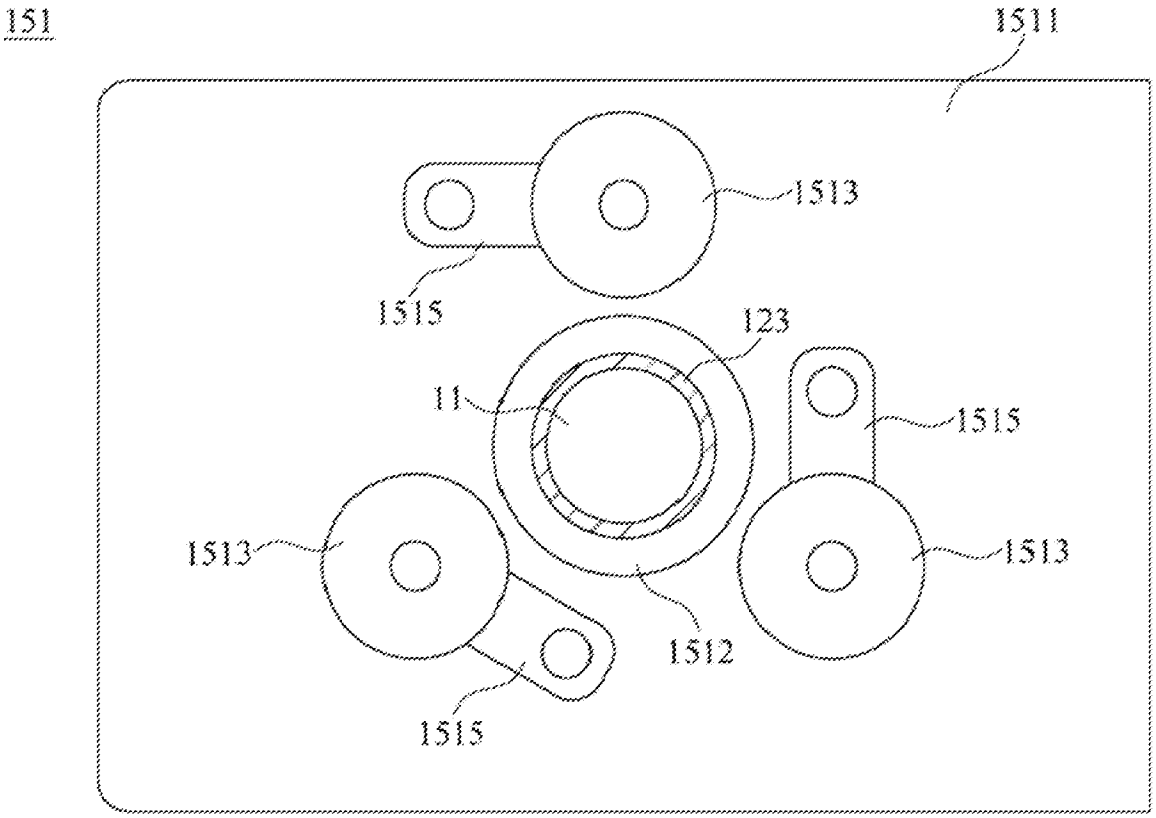
FIG. 3 is a schematic view, in an enlarged form, showing a cutter of the paper tube making and cutting machine according to an embodiment of the present invention.

The cutter 151 is arranged adjacent to the fixed rod 11 and is operable to cut the paper tube 123 formed on the fixed rod 11 into fixed-length pieces of the paper tube 123. In an embodiment of the present invention, as shown in FIG. 3, the cutter 151 comprises a base plate 1511, a plurality of rolling cutters 1513 and a plurality of swing arms 1515.

Each of the rolling cutters 1513 is connected by a corresponding one of the swing arms 1515 to the base plate 1511. In an example, the number of the rolling cutters 1513 is three.

The base plate 1511 is formed with a through hole 1512, so that the fixed rod 11 and/or the paper tube 123 are extended through the through hole 1512 of the base plate 1511. The rolling cutters 1513 are arranged on a circumference around the through hole 1512, so as to be set in a circumferentially distributed manner. The swing arms 1515 are operable to drive the rolling cutters 1513 to swing or rotate relative to the base plate 1511, such that the rolling cutters 1513 are moved relative to the through hole 1512 of the base plate 1511 and the fixed rod 11 and/or the paper tube 123. For example, a motor can be used to drive the swing arms 1515 to rotate or swing. In cutting the paper tube 123, the swing arms 1515 are operated to drive the rolling cutters 1513 to move toward the fixed rod 11 and the paper tube 123 in order to cut the paper tube 123 formed on the fixed rod 11. The above-described specifics or details of the structure of the cutter 151 are provided to illustrate one embodiment of the present invention and are not intended to impose undue constraint to the scope of protection that the present invention seeks for.

The cutter 151 is connected to the drive mechanism 153, and the drive mechanism 153 is operable to drive the cutter 151 to move along the fixed rod 11. In an example, the drive mechanism 153 comprises a stepping motor. In an embodiment of the present invention, at least one slide rail 161 is mounted on the machine frame 110, and the cutter 151 is connected by at least one sliding block 163 to the slide rail 161, so that the drive mechanism 153 drives the cutter 151 and the sliding block 163 to move along the slide rail 161 and the fixed rod 11.

During a cutting operation of the paper tube 123 performed by the cutter 151 according to the present invention, the drive mechanism 153 drives the cutter 151 to move in a direction that is identical to a direction in which a length of the paper tube 123 is extended or increasing, and the drive mechanism 153 drives the cutter 151 to move at a speed that is similar or identical to an increasing amount of the length of the paper tube 123 in a unit time. For example, when the paper tube 123 is generated and extended for the length thereof at a generation rate or producing speed of 10 cm/s, the drive mechanism 153 similarly drives the cutter 151 to move along the fixed rod 11 at a speed of 10 cm/s.

In the present invention, due to the moving speed of the cutter 151 is identical to the producing speed or generation rate of the paper tube 123, the paper tube 123 does not apply a force to push the sides of the cutter 151 when the cutter 151 is put in operation to cut off the paper tube 123. In comparison with the present invention, a prior art cutter, during cutting of a paper tube, is not moved in the extension direction or producing direction of the paper tube, and consequentially, the paper tube would push the sides of the cutter 151 or, alternatively, the cutter 151 pulls or stretches the paper tube 123, so as to affect the quality of cutting of the paper tube and also to increase the rate of damage for the cutter.

To achieve the above objective, the present invention adjusts and varies the moving speed of the cutter 151 as being driven by the drive mechanism 153 by making computation on the producing speed or generation rate of the paper tube 123. Specifically, the paper tube making and cutting machine 10 according to the present invention comprises an angle measurement unit 14 and a length measurement unit 171. The angle measurement unit 14 is operable to measure an angle of the paper tape winding mechanism 13 relative to the fixed rod 11, or alternatively to measure the feed-in angle of the paper tape 121 relative to the fixed rod 11, and the length measurement unit 171 is operable to measure a conveyed length of the paper tape 121.

In an embodiment of the present invention, the angle measurement unit 14 is connected to the paper tape winding mechanism 13, or alternatively arranged adjacent to the paper tape winding mechanism 13, to measure a tilt angle of the paper tape winding mechanism 13. For example, the angle measurement unit 14 is implemented as or comprises a tilt angle measurement device.

Figure 4:
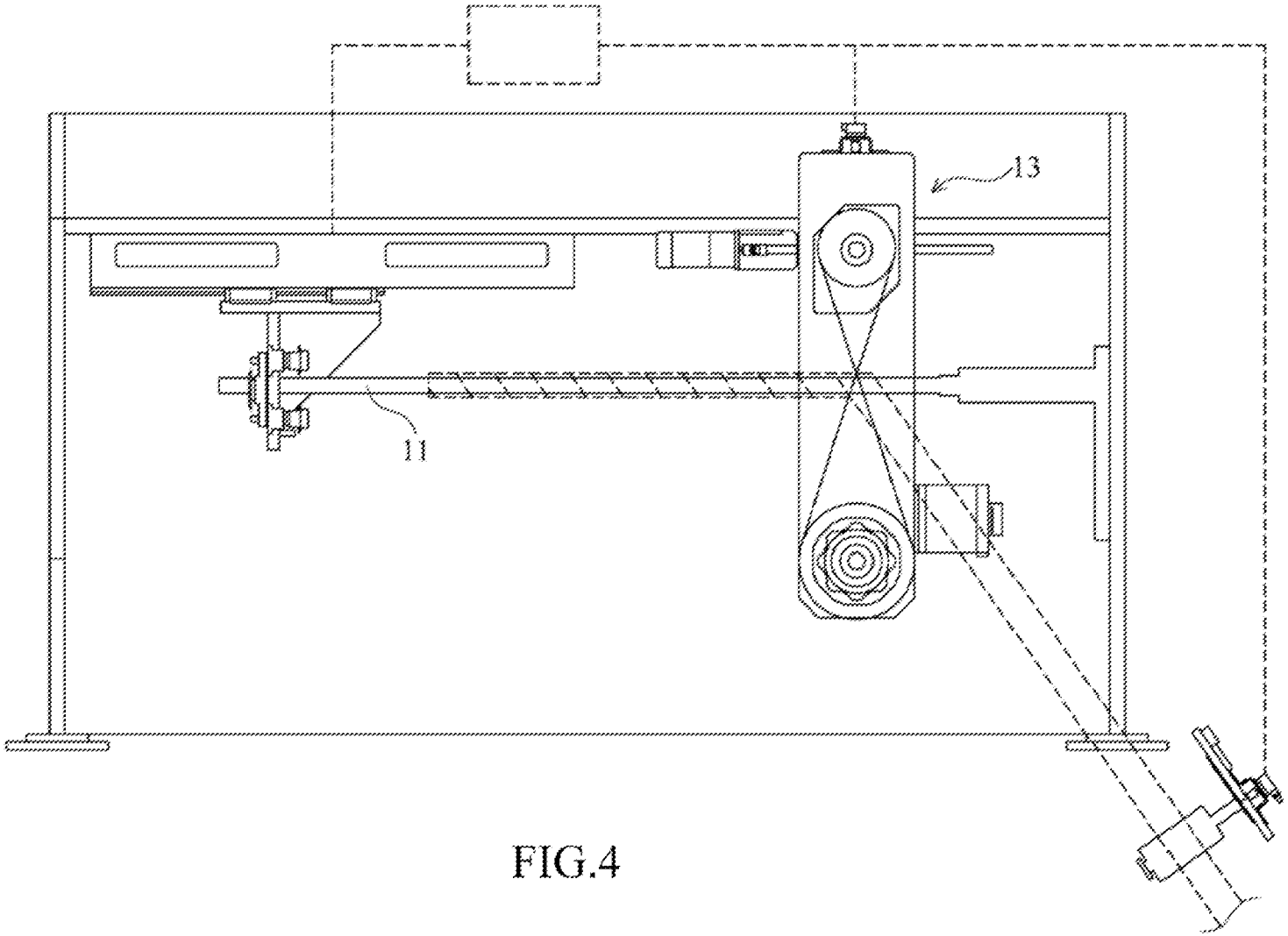
FIG. 4 is a schematic view showing a structure of a paper tube making and cutting machine according to another embodiment of the present invention.

The paper tape winding mechanism 13 and the supporting plate 131 are rotatable relative to the fixed rod 11, as shown in FIGS. 1 and 4, in order to change the angle at which the belt 137 is wound around the fixed rod 11 so as to adjust the feed-in angle of the paper tape 121 wound around the fixed rod 11. Basically, the feed-in angle of the paper tape 121 relative to the fixed rod 11 is related to the angle between the paper tape winding mechanism 13 and the fixed rod 11, and in an embodiment of the present invention, the feed-in angle of the paper tape 121 relative to the fixed rod 11 is calculated based on the angle between the paper tape winding mechanism 13 and the fixed rod 11.

Figure 5:
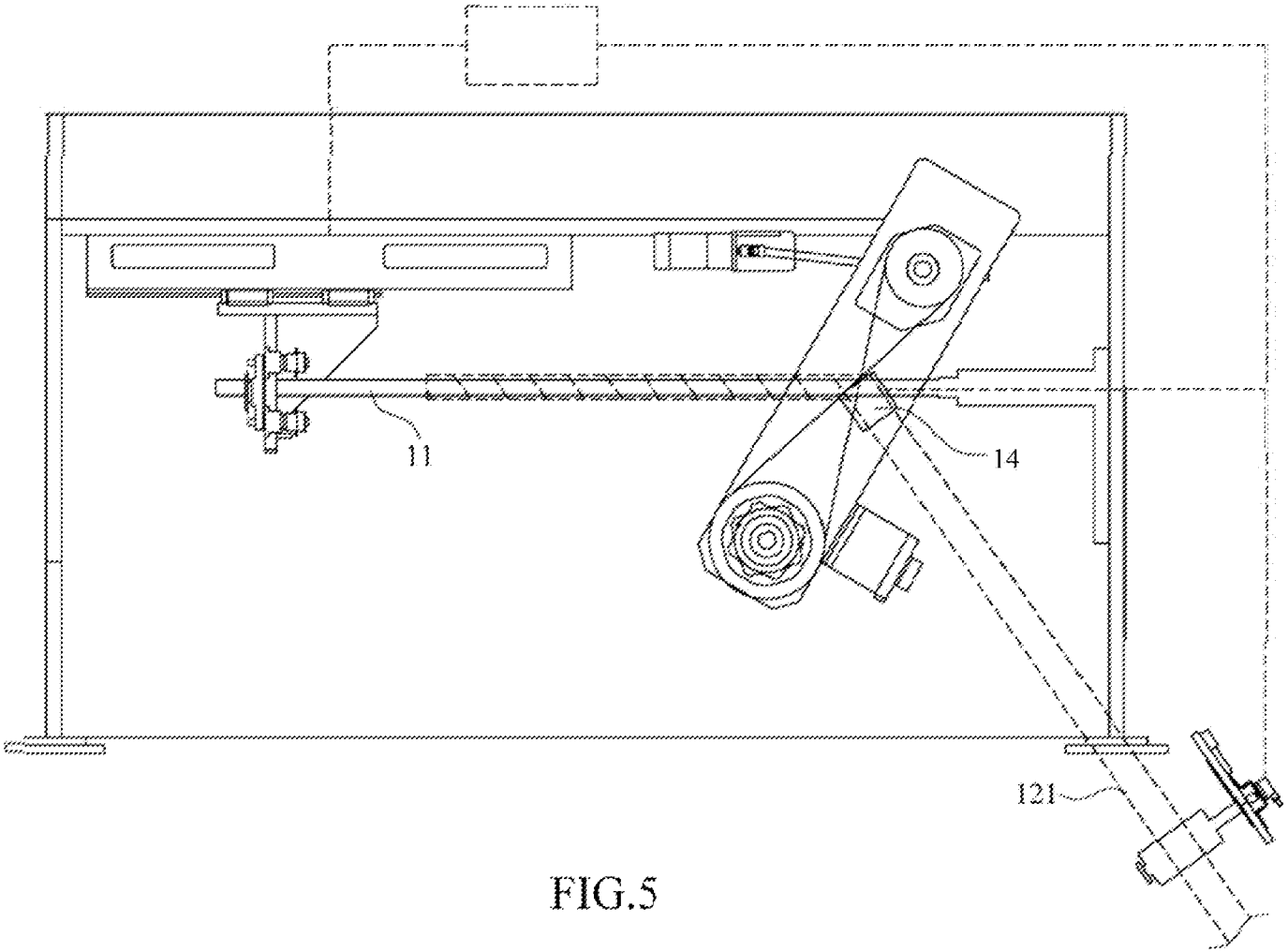
FIG. 5 is a schematic view showing a structure of a paper tube making and cutting machine according to a further embodiment of the present invention.

In another embodiment of the present invention, direct measurement is taken for the feed-in angle of the paper tape 121 relative to the fixed rod 11. As shown in FIG. 5, the angle measurement unit 14 is arranged to be close to the site where the paper tape 121 moves onto the fixed rod 11 to directly measure the angle between the paper tape 121 and the fixed rod 11, such as the feed-in angle of the paper tape 121.

The length measurement unit 171 is arranged an upstream of the fixed rod 11 and the paper tape winding mechanism 13 to measure the conveyed length of the paper tape 121. In an embodiment of the present invention, at least one transportation roller 173 is disposed the upstream of the fixed rod 11 and the paper tape winding mechanism 13, and the transportation roller 173 functions to convey and supply the paper tape 121 onto the fixed rod 11 and the paper tape winding mechanism 13. The length measurement unit 171 is connected to one such transportation roller 173 to count the turns of rotation of the transportation roller 173 so as to calculate the conveyed length of the paper tape 121.

The producing speed or generation rate of the paper tube 123 is related to the conveyed length of the paper tape 121 and the feed-in angle between the paper tape 121 and the fixed rod 11, so that through measurement of the feed-in angle and the conveyed length of the paper tape 121 would enable calculation of the increasing amount of the length of the paper tube 123 in a unit time.

As a result, during cutting of the paper tube 123 with the cutter 151, the speed at which the cutter 151 is moving along the fixed rod 11 can be adjusted and varied according to the angle and the conveyed length, such as the moving speed of the cutter 151 being adjusted according to the producing speed or generation rate of the paper tube 123 so as to make them identical or similar to each other. In other embodiments, an included angle between the paper tape winding mechanism 13 and the supporting plate 131 is converted into the (feed-in) angle between the paper tape 121 and the fixed rod 11, and as such, the producing speed or generation rate of the paper tube 123 can be calculated according to the included angle between the paper tape winding mechanism 13 and the supporting plate 131 and the conveyed length of the paper tape 121.

In a practical application, measures may be taken to further identify the perimeter and/or the radius of the paper tube 123 and the width W and/or the thickness of the paper tape 121, so that a more accurate calculation of the producing speed or generation rate of the paper tube 123 may be done according to the perimeter of the paper tube 123, the width W and the thickness of the paper tape 121, and the feed-in angle and the conveyed length. The perimeter of the paper tube 123 is related to the perimeter of the fixed rod 11, for example the perimeter of the paper tube 123 is close to or corresponding to the perimeter of the fixed rod 11.

Figure 6:
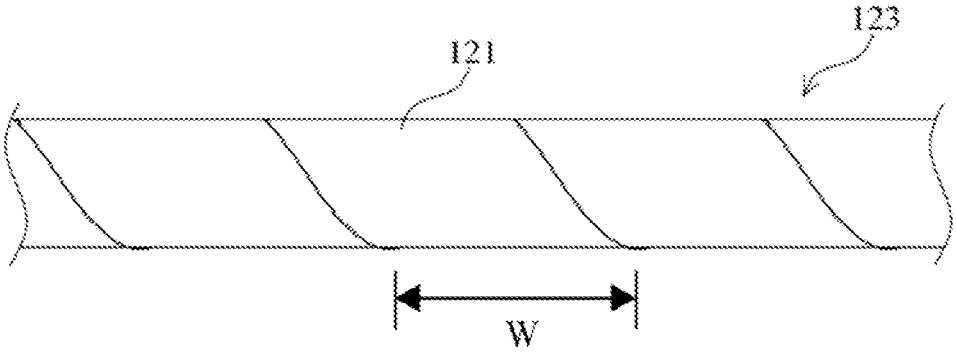
FIG. 6 is a schematic view showing an example of a structure of a paper tube formed by the paper tube making and cutting machine according to the present invention.

Further, the rate of the paper tube 123 is also related to how the paper tape 121 is wound. For example, adjacent turns of the paper tape 121 that are wound around the fixed rod 11 do not overlap with each other as shown in FIG. 6, and as such, the producing speed or generation rate of the paper tube 123 can be calculated according to the included angle between the paper tape winding mechanism 13 and the fixed rod 11, the perimeter of the paper tube 123, the width W and the thickness of the paper tape 121, and the feed-in angle and/or the conveyed length, and the speed at which the cutter 151 is moving as being driven by the drive mechanism 153 can be adjusted accordingly.

Figure 7:
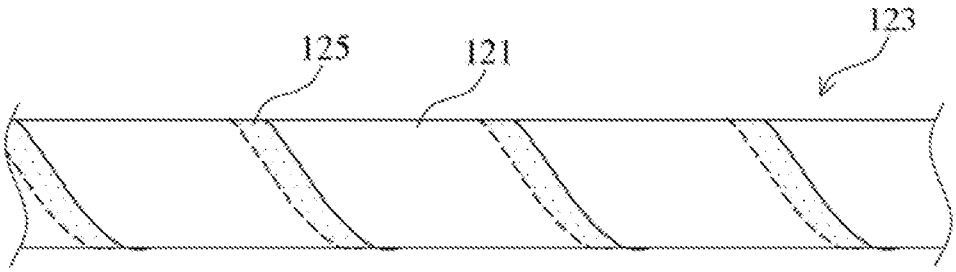
FIG. 7 is a schematic view showing another example of a structure of a paper tube formed by the paper tube making and cutting machine according to the present invention.

In other embodiments, adjacent turns of the paper tape 121 wound around the fixed rod 11 overlap each other, as shown in FIG. 7, such that the paper tape 121 that forms the paper tube 123 may include an overlapping zone 125. Consequently, calculation of the producing speed or generation rate of the paper tube 123 must take the width of the overlapping zone 125 into account.

In a practical application, the paper tube making and cutting machine 10 may comprise a calculation unit 18, and in an example, the calculation unit 18 comprises a computer. The calculation unit 18 is electrically connected to the angle measurement unit 14, the length measurement unit 171, and the drive mechanism 153 and receive data concerning angle and conveyed length from the angle measurement unit 14 and the length measurement unit 171 in order to make calculation on the producing speed or generation rate of the paper tube 123, and, then in response to the producing speed or generation rate of the paper tube 123, controls the moving speed of the cutter 151 as being driven by the drive mechanism 153. Further, the calculation unit 18 may also receive data concerning the radius of the fixed rod 11 and the width of the paper tape 121, in order to carry out calculation or determination of the producing speed or generation rate of the paper tube 123 according to the angle, the conveyed length, the radius of the fixed rod 11, and the width of the paper tape 121.

Specifically, in the paper tube making and cutting machine 10 according to the present invention, a direction in which the cutter 151 is moved is identical to a direction in which the paper tube 123 is generated and extending. Further, the moving speed of the cutter 151 is also made identical to the producing speed or generation rate of the paper tube 123. Thus, during a process of cutting the paper tube 123 with the cutter 151, the paper tube 123 does not push the cutter 151 sideways or the cutter 151 does not pull or stretch the paper tube 123, so that the cutting quality of the paper tube 123 is enhanced and the service life of the cutter 151 is extended.

Figure 8:
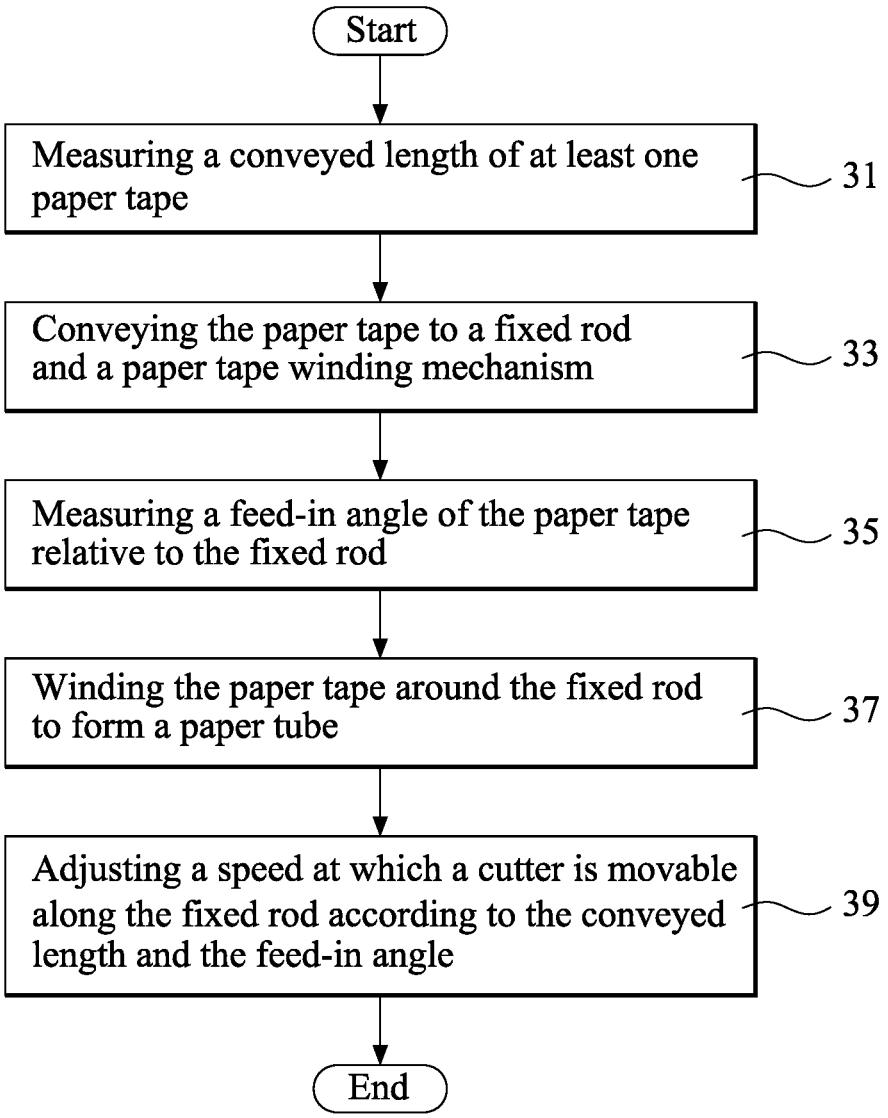
FIG. 8 is a flow chart illustrating a paper tube cutting method of the paper tube making and cutting machine according to the present invention.

Referring to FIG. 8, a flow chart is provided to illustrate a paper tube cutting method implementable with the paper tube making and cutting machine according to the present invention. Referring additionally to FIG. 1, a conveyed length of at least one paper tape 121 is measured, as indicated at Step 31, wherein the length measurement unit 171 is operable, in combination with the transportation roller 173, to make the measurement of the conveyed length of the paper tape 121.

The paper tape 121 is conveyed to the fixed rod 11 and the paper tape winding mechanism 13, as indicated at Step 33, wherein a portion of the paper tape 121 is located in a gap between the fixed rod 11 and the paper tape winding mechanism 13 and the paper tape winding mechanism 13 is put in operation to drive and move the paper tape 121.

A feed-in angle of the paper tape 121 relative to the fixed rod 11 is then measured, as indicated at Step 35. In an embodiment of the present invention, the feed-in angle of the paper tape 121 relative to the fixed rod 11 is directly measured using the angle measurement unit 14. In other embodiments, the angle measurement unit 14 first measures an angle between the paper tape winding mechanism 13 and the fixed rod 11 for subsequent calculation of the feed-in angle of the paper tape 121 relative to the fixed rod 11.

The paper tape 121 is then wound around the fixed rod 11 to form and make a paper tube 123, as indicated at Step 37. Specifically, the paper tape winding mechanism 13 is put into operation to wrap or wind the paper tape 121 around the fixed rod 11 to form the paper tube 123.

A speed at which the cutter 51 is moving along the fixed rod 11 is then adjusted and regulated according to the conveyed length and the feed-in angle, as indicated at Step 39. Specifically, a producing speed or generation rate of the paper tube 123 is calculated according to the feed-in angle of the paper tape 121 relative to the fixed rod 11 and the conveyed length of the paper tape 121, and the speed of the cutter 151 moving along the fixed rod 11 is set to be identical to or close to the producing speed or generation rate of the paper tube 123, in order to enhance the cutting quality of the paper tube 123 and the service life of the cutter 151.

In another embodiment of the present invention, the perimeter and/or the radius of the paper tube 123 or the fixed rod 11 and the width W and/or the thickness of the paper tape 121 are measured, so that a more accurate calculation of the producing speed or generation rate of the paper tube 123, as well as the moving speed of the cutter 151, may be done according to the radius and the perimeter of the paper tube 123 or the fixed rod 11, the width W and the thickness of the paper tape 121, and the feed-in angle and the conveyed length, and adjustment can be made for the moving speed of the cutter 151 along the fixed rod 11.

Further, the calculation of the producing speed or generation rate of the paper tube 123 may be done by further taking the width of an overlapping zone 125 between adjacent portions of the paper tape 121 that makes the paper tube 123, so that the moving speed of the cutter 151 along the fixed rod 11 can be adjusted according to the conveyed length, the feed-in angle, the radius of the fixed rod 11, the width of the paper tape 121 and the overlapping zone 125.

The above description is made only to provide an illustration to a preferred embodiment of the present invention and is not intended to limit the application and embodiment of the present invention. Equivalent variation and modification in respect of shape, structure, feature, and spirit that fall in the appended claims with which the present invention is solely defined are considered within the scope of the present invention as defined in the claims.

What is claimed is:

1. A method for making a paper tube, comprising:

arranging at least one transportation roller upstream of a fixed rod for conveying at least one paper tape to the fixed rod and a paper tape winding mechanism, wherein the at least one paper tape is devoid of markings;

counting rotations of the at least one transportation roller for measuring a conveyed length of the at least one paper tape for conveying to the fixed rod;

conveying the at least one paper tape to the fixed rod and the paper tape winding mechanism;

measuring an angle between the paper tape winding mechanism and the fixed rod to calculate a feed-in angle of the paper tape relative to the fixed rod;

measuring an angle of the at least one paper tape relative to the fixed rod for further calculating the feed-in angle of the paper tape relative to the fixed rod;

wrapping the at least one paper tape around the fixed rod to form the paper tube; and adjusting a speed at which a cutter is movable along the fixed rod according to the conveyed length and the feed-in angle.

2. The method according to claim 1, further comprising:

obtaining a radius of the fixed rod and a width of the at least one paper tape; and adjusting the speed at which the cutter is movable along the fixed rod according to the conveyed length, the feed-in angle, the radius of the fixed rod, and the width of the at least one paper tape.

3. The method according to claim 2, further comprising:

obtaining a width of an overlapping zone of adjacent portions of the at least one paper tape of the paper tube; and adjusting the speed at which the cutter is movable along the fixed rod according to the conveyed length, the feed-in angle, the radius of the fixed rod, the width of the at least one paper tape, and the overlapping zone.

* * * * *